United States Patent [19]

Watanabe et al.

[11] 4,106,627

[45] Aug. 15, 1978

[54] METHOD AND APPARATUS FOR USE IN SEPARATION AND RECOVERY OF NON-MAGNETIC METAL PIECES

[75] Inventors: Ryuji Watanabe; Syoichi Sato, both of Ibaraki; Sadami Tomita, Katsuta, all of Japan

[73] Assignee: Agency of Industrial Science & Technology, Tokyo, Japan

[21] Appl. No.: 650,852

[22] Filed: Jan. 21, 1976

[30] Foreign Application Priority Data

Jan. 30, 1975 [JP] Japan ..... 50-11916

[51] Int. Cl.[2] ..... B03B 1/00

[52] U.S. Cl. ..... 209/7; 209/38; 209/212; 209/227

[58] Field of Search ..... 209/216, 7, 38, 219, 209/212, 222, 227, 214 P; 210/222 P, 20, 24

[56] References Cited

U.S. PATENT DOCUMENTS

| | | | |
|---|---|---|---|
| 250,156 | 11/1881 | McKellar | 209/7 |
| 402,684 | 5/1889 | Maxim | 209/212 |
| 704,010 | 7/1902 | Edison | 209/38 |
| 1,175,966 | 3/1916 | Lovett | 209/7 X |
| 1,836,252 | 12/1931 | Johnson | 209/216 X |
| 2,487,272 | 11/1949 | Price | 209/212 |
| 2,766,888 | 10/1956 | Queneau | 209/219 |
| 3,045,822 | 7/1962 | Cavanagh | 209/219 |
| 3,133,015 | 5/1964 | Cavanagh | 209/219 X |
| 3,448,857 | 6/1969 | Benson | 209/212 |
| 3,605,243 | 9/1971 | Oster | 209/38 X |
| 3,687,062 | 8/1972 | Frank | 209/38 X |
| 3,824,516 | 7/1974 | Benowitz | 209/212 |
| 3,950,661 | 4/1976 | Langmuir | 209/227 |
| 4,003,830 | 1/1977 | Schloemann | 209/212 |

FOREIGN PATENT DOCUMENTS

| | | | |
|---|---|---|---|
| 138,501 | 1/1902 | Fed. Rep. of Germany | 209/7 |
| 945,741 | 7/1956 | Fed. Rep. of Germany | 209/219 |
| 2,059,166 | 6/1972 | Fed. Rep. of Germany | 209/223 R |

*Primary Examiner*—Robert Halper
*Attorney, Agent, or Firm*—Beall & Jeffery

[57] ABSTRACT

An apparatus for use in separation and recovery of pieces of different materials according to the difference in electric conductivity of each kind of materials, by utilizing the interaction between a magnetic field, induced by the eddy current and an external magnetic field. The separating capability of the apparatus of the type is largely dependent upon the shape of pieces being separated as well as the difference in electric conductivity between the pieces of different materials. According to the apparatus of the present invention, samples to be separated are rolled into a flat shape, then subjected to the screening, followed by their passing through a plurality of rotating magnetic fields whose intensities are being increased one by one, whereby the sample pieces are separated effectively according to their electric conductivity, and thus recovered.

20 Claims, 3 Drawing Figures

FIG. 1
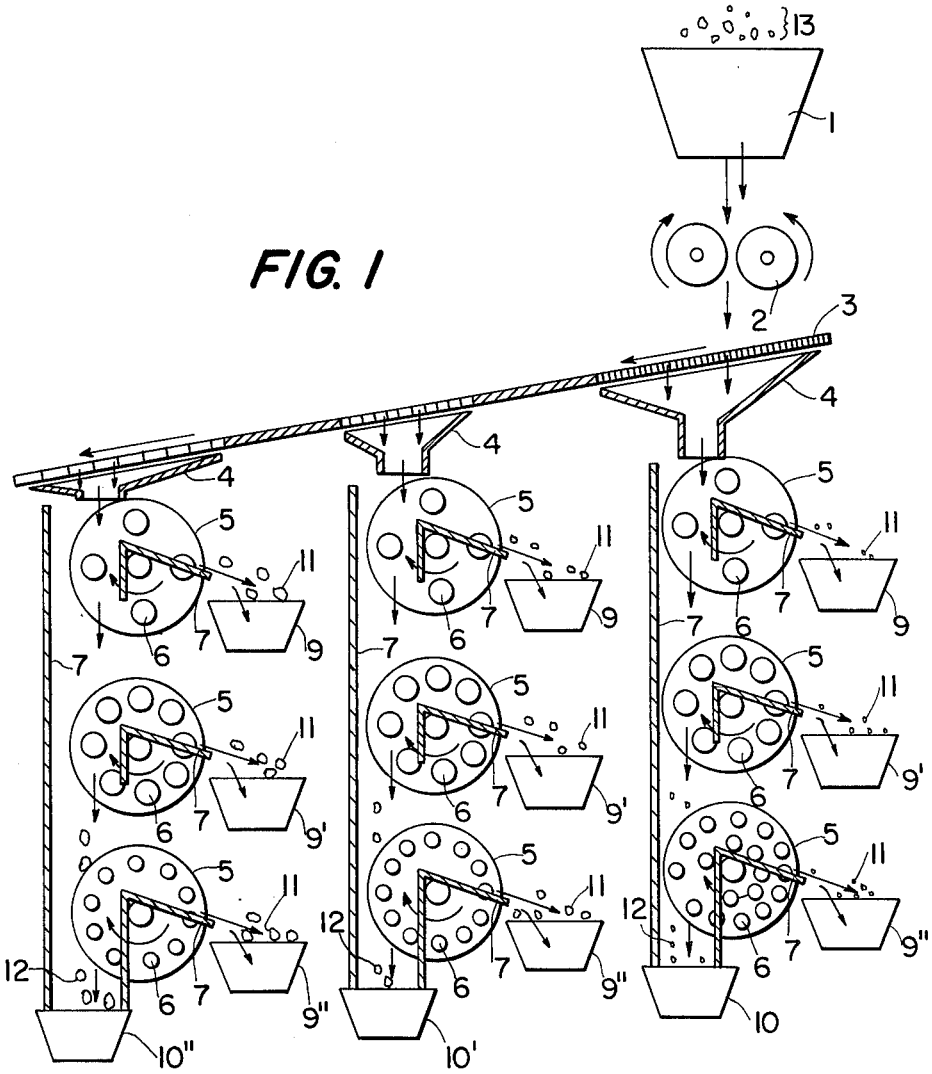
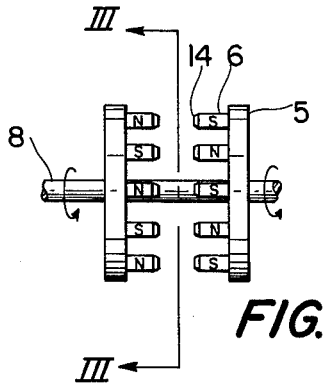
FIG. 2
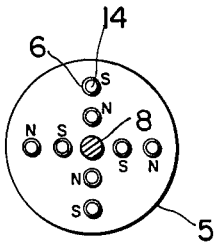
FIG. 3

METHOD AND APPARATUS FOR USE IN SEPARATION AND RECOVERY OF NON-MAGNETIC METAL PIECES

BACKGROUND OF THE INVENTION:

This invention relates to an apparatus for recovering valuable metals from solid scrap mixed non-magnetic metals and non-metallic materials, and more particularly to a separating apparatus using eddy currents, which apparatus is equipped with a device for rolling non-magnetic metal pieces and a device for screening these metal pieces according to sizes.

For recovery of metals from crushed metal pieces or ore pieces, there is known a method for recovering metals according to the magnetic susceptibility of such metals, i.e. by means of a magnetic separator utilizing a magnetic attracting force of such a metal. On the other hand, separation of metals having low susceptibility, or non-magnetic metals, such as copper, aluminum and zinc, has been practiced manually. With a view to automating the recovery of non-magnetic metal pieces, an attempt has been proposed for crushing such non-magnetic metal pieces into fine pieces and separating for recovery fine pieces of nonmagnetic metals according to an electromagnetic technique. More in detail, a method has been proposed in which an abrupt change in magnetic fields is applied to a mixture of non-magnetic metal pieces and non-metallic pieces, so as to induce eddy currents in the metal pieces only, and separation of non-magnetic metal pieces from non-metallic pieces is carried out by the interaction between a magnetic field induced by the eddy currents and an external magnetic field. The principle of such a method is disclosed, for example, in the U.S. Pat. No. 3,448,857. The separating capability of an apparatus disclosed therein is largely dependent upon the shape, size and density of crushed pieces being separated. Particularly, the shape of metal pieces should preferably be flat for increasing the quantity of magnetic flux permeating therethrough. With the prior art apparatus for use in separation and recovery of non-magnetic metal pieces, however, it has been customary to charge the apparatus with crushed pieces of a randum shape and varying sizes, so that eddy currents have found difficulty in flowing through fine, lump-like crushed pieces. Accordingly, a strong magnetic field and high field frequency have been required. This has offered a difficulty in the manufacture of the separating apparatus as well as presented disadvantages from the viewpoint of accuracy in separation. Another problem has been encountered with the case where crushed pieces of a randum shape and varying sizes are processed at a time in the aforesaid separating apparatus, i.e., crushed pieces of a large size tend to wrap small-sized pieces therein, leading to the lowered separating accuracy of the apparatus. Furthermore, due to the fact that the metal pieces having high electric conductivity, such as aluminum and copper, are separable more easily than the other, it is imperative that a magnetically improved separating condition be provided for pieces of other metals, such as tin, zinc, lead, their alloys and stainless steels.

SUMMARY OF THE INVENTION

It is accordingly the first object of the present invention to provide an apparatus for use in separation and recovery of non-magnetic metal pieces, which apparatus provides an improved separating capability.

It is the second object of the present invention to provide an apparatus for use in separation and recovery of non-magnetic metals, which apparatus is high in separating efficiency, economical and presents improved separating performance.

It is the third object of the present invention to provide an apparatus for use in separation and recovery of metal pieces which makes use of slight differences in electric conductivity, according to the types of materials.

According to the apparatus for use in separation and recovery of non-magnetic metal pieces from mixture of non-magnetic metal pieces and non-metallic material pieces in the present invention, piece samples to be separated are worked into a piece shape suited for inducing eddy currents in pieces, when the piece samples are placed in the rotating magnetic fields, and then screened according to a piece size. A mixture of non-magnetic metal and non-metal pieces thus screened according to a pieces size are then placed in the rotating magnetic fields and moved due to a repulsive force which is produced according to the interaction between the magnetic fields created due to the eddy currents, and the rotating magnetic fields. According to a difference in displacement among the pieces, such pieces are sorted by a type of the materials thereof. So, if the mixture passes through a plurality of rotating magnetic fields whose intensities are increased one by one, the mixture may be separated efficiently.

BRIEF DESCRIPTION OF THE DRAWINGS

FIG. 1 diagramatically shows the outline of an apparatus for use in separation and recovery of non-magnetic metal pieces according to one embodiment of the present invention;

FIG. 2 is a side view of a pair of discs having rotating magnetic fields; and, FIG. 3 is a longitudinal cross sectional view taken along the line III—III of FIG. 2.

DETAILED DESCRIPTION OF THE INVENTION

A device is known, which separates non-magnetic metal pieces, such as copper and aluminum, which are impossible to separate by magnetic separating method, from a mixture of non-magnetic metal and non-metal pieces according to the laws in the electromagnetics, in which if an electric conductor is placed in an alternating magnetic field, eddy currents flow through the electric conductor, and due to the interaction of the eddy currents and external moving magnetic fields, electromagnetic forces are produced. The construction of the foregoing device is such that a plurality of permanent magnets in the form of a rods for producing a ferromagnetic field are embedded concentrically in non-magnetic rotary discs, with the different magnetic poles disposed alternately, and a pair of the aforesaid rotary discs are disposed so that their magnets are in facing relation to each other, with a space left therebetween and are rotated coaxially around a horizontal axis. If a mixture of metal and non-metal pieces is thrown in a space between the discs which are rotating at a high speed, the metal pieces alone receive an electromagnetic force in the rotating direction of the magnetic field, while the non-metal pieces drop due to their own weights, without being affected by the influence of a magnetic field. In this case, therefore, the provision of a proper stopper position midway in the device permits separation of metal pieces from non-metal pieces. In the aforesaid separating and recovering apparatus, one factor for effectively achieving the effect of an electromagnetic force is to shape each metal piece flatwise so as to increase the quantity of magnetic flux which permeates therethrough. The metal pieces crushed by a general type crusher are irregular in shape, and in case the metal pieces are of a fine, lump- or linear shape, the magnetic flux is hard to permeate therethrough, as compared with the case of the flat metal pieces, resulting in the lowered separation accuracy. The separating apparatus of the present invention successfully overcomes the above-described problems of the shape of crushed pieces. More specifically, with a view to sorting the crushed pieces according to the piece size for avoiding a risk of the crushed pieces of a small size being wrapped with the crushed pieces of a large size, as well as to providing flat, crushed pieces, the crushed pieces to be separated are rolled through a pair of rolls after being crushed, and then subjected to continuous screening for being classified into large size pieces and small size pieces. Since small metal pieces produce an electromagnetic force with difficulty, as compared with large metal pieces, it is imperative to increase the intensity of magnetic fields in magnetic field rotating discs. To this end, a plurality of rotary discs are provided, which are different in conditions such as the arrangement of magnetic fields, field frequency and spacial magnetic fields, so that the crushed pieces may be separated according to a size, and thus an improved separation accuracy is provided. On the other hand, crushed pieces sorted to one size level according to the screening step vary to a large extent in separability, because of their varying electric conductivities and densities. It has been proven through a series of tests that the force of an eddy current which acts on a metal in the magnetic-field-rotating conditions as shown in Table 1 is largely dependent upon the type of a material and the shape of respective metal pieces. Taking the above fact in view and coupled with the aforesaid effects of the shapes of crushed pieces, the recovery apparatus of the present invention is so arranged that a plurality of pairs of separating discs are disposed in the vertical direction in a manner that their magnetic fields are increasingly intensified from the top to the bottom, so that aluminum pieces most liable to be separated are first separated, then copper pieces the second, and finally the non-metallic pieces other than those metal pieces, and the magnetic field conditions for respective types of materials and sizes are determined so as to conform to Table 1. By the use of the apparatus thus arranged, an effective separation of crushed pieces according to the shape and the type of a material is ensured, and thus an improved recovery efficiency is obtained.

EXAMPLE 1

FIG. 1 shows one embodiment of the apparatus for use in separation and recovery of non-magnetic metal pieces according to the present invention, while FIGS. 2 and 3 show a side view and a longitudinal cross sectional view of rotating discs using this apparatus, respectively. The separating apparatus is composed of a portion, in which a mixture of crushed metal and non-metal pieces is supplied; a portion, in which the mixture is subjected to the rolling process; a portion, in which the pieces thus rolled, are screened according to sizes by a comb-shaped vibration screen; a portion, in which the crushed pieces thus screened are separated according to change of magnetic field by the rotating magnetic field discs; and a portion, by which the metal pieces thus separated and non-metal pieces are received for recovery, respectively. The materials or crushed pieces 13 being separated, which have been thrown in a hopper 1, pass through a pair of rolls 2, thereby being pressed into a flat shape for facilitating permeation of an increased quantity of magnetic flux therethrough. The materials thus pressed are screened by an inclined, comb-shaped vibrating-screening means 3 according to piece sizes alotted to each stage of screening means. The crushed pieces thus screened are caused to drop from respective funnel-shaped transporting guides 4 into a magnetic field between each pair of rotating discs 5 disposed in facing relation to each other. On respective rotating discs 5, there are positioned a plurality of permanent magnets 6, with their north and south poles placed alternately with respect to each other. For the purpose of increasing the density of magnetic flux, pole pieces 14 are attached to the ends of respective magnets, as shown in FIG. 2. A rotary shaft 8 of the discs 5 should preferably be a magnetic yoke for facilitating the connection between magnetic circuits. The r.p.m. of respective rotating discs 5 should be determined, for example, according to the frequency of magnetic-field-change as given in Table 1. Of the crushed pieces 13 which have been dropped into the rotating magnetic fields generated by the discs 5 in FIG. 1, the non-magnetic metal pieces 11 receive the driving force in the rotating direction of the discs 5 in the different rotating magnetic fields of the discs 5 in correlation with the electrical property of the respective non-magnetic metal pieces so as to be separated from the non-metallic pieces, thereby being collected in the recovery containers 9, by means of respective stoppers 7, comprising vertical and inclined partitions as shown in FIG. 1. The non-metallic pieces 12 are collected in respective recovery containers 10. For example, the separating apparatus shown in FIG. 1 is characterized by the combination of plural pairs of rotary discs arranged such that aluminum pieces are separated by the top rotary discs, the copper pieces by the middle rotary discs, and the other Table 1

| Material to be separated | Aluminum piece | | | Copper piece | | | Other non-magnetic metal piece | | |
|---|---|---|---|---|---|---|---|---|---|
| Size of crushed piece being separated (mm) (one side of the cube) | 8< | 8 – 20 | 20 – 50 | 8< | 8 – 20 | 20 – 50 | 8< | 8 – 20 | 20 – 50 |
| Density of magnetic flux in gap between magnetic pole pieces (Gauss) | 3000<br>5000 | 1000<br>4000 | 800<br>1500 | 6000<br>9000 | 4000<br>7000 | 2000<br>5000 | 8000<br>12000 | 6000<br>9000 | 5000<br>8000 |
| Field frequency (f) f = the number of poles × n (rpm) | 500<br>1000 | 300<br>700 | 100<br>500 | 4000<br>15000 | 2000<br>5000 | 1500<br>3000 | 20000<br>50000 | 10000<br>25000 | 5000<br>15000 |

non-magnetic metal pieces such as lead, zinc, brass and stainless steel, by the bottom rotary discs, respectively. By the use of the separating apparatus thus arranged, the recovering efficiency of aluminum and copper crushed pieces screened according to piece sizes was more than 96%.

The most remarkable feature of the separating apparatus according to the present invention is that plural pairs of rotary discs are arranged in the vertical direction according to the sizes and types of the crushed pieces being separated, so that the crushed pieces may be continuously separated in a manner that aluminum pieces most liable to be separated are first separated, and then the copper pieces, while the other metal pieces reluctant to separation are transported to the rotary discs whose magnetic field conditions are raised to a greater extent than the others. With this arrangement, there is little possibility of different types of metal being admixed with each other, providing an easy handling of valuable metal pieces, when the same are reused.

In reusing metal scraps, it is a recent trend that separation of ferromagnetic metal pieces such as iron and nickel is conducted according to a magnetic separating technique, while separation of non-magnetic metal pieces such as copper and aluminum is mainly conducted manually. The apparatus for use in separation and recovery of non-magnetic metal pieces according to the present invention is of much promise from the scrap treatment and material-resource-reusing viewpoints. In the separating apparatus of the present invention, the crushing of materials are immediately followed by separation and recovery of the crushed pieces. In other words a dry system is persistently adopted, rather than a wet system, which is advantageous from viewpoints of public nuisance.

Included by methods to flatten the crushed pieces, are vertically pressing means and means for heating such pressing means, besides the rolling means using a pair of rolls.

The means for screening the crushed pieces according to piece sizes should not always be of a comb-shaped, vibrating type but may be of other types. The screening sizes and the number of rotating discs may be increased so as to increase the capacity of processing apparatus and to improve the accuracy in processing.

What is claimed is:

1. An apparatus for use in separation and recovery of crushed non-magnetic metal pieces from a mixture of crushed non-magnetic metal pieces and crushed non-metallic pieces, comprising:

means for deforming at least said non-magnetic metal pieces among said mixed crushed pieces to flattened shapes of relatively small thickness;

means for screening the mixture that includes the flattened crushed non-magnetic metal pieces into a given size range of screened mixture;

horizontally spaced apart vertical and inclined partition means forming therebetween a separation space;

means for receiving the screened mixture and freely dropping the screened mixture of crushed pieces including flattened non-magnetic metal pieces through the separation space to fall freely by gravity;

means for producing a rotating magnetic field having an axis generally perpendicular to the path of the freely falling crushed pieces, having at least some of only its upwardly rotating field in said separation space so as to induce eddy currents in said flattened non-magnetic metal pieces contained in the screened mixture of freely falling crushed pieces, and thereby in cooperation with vertical partition means laterally deflecting away from said vertical partition means at least some of the freely falling non-magnetic metal pieces having eddy currents induced therein from their freely falling path away from the freely falling other pieces by the electromagnetic forces acting between the rotating magnetic field and the eddy currents generated in the non-magnetic metal pieces;

said inclined partition means extending from the vicinity of the axis of the rotating magnetic field away from said vertical partition means downwardly to outside the rotating magnetic field for separating the path of the other pieces from the path of the laterally deflected non-magnetic metal pieces and for guiding the laterally deflected non-magnetic metal pieces, to thereby separate non-metallic pieces from non-magnetic metal pieces; and means for receiving the separated non-magnetic metal pieces from said inclined partition means separately and apart from the separate non-metallic pieces.

2. The apparatus as defined in claim 1, wherein said means for deforming is a rolling mill, and means for guiding the mixture of crushed non-magnetic metal pieces and crushed non-metallic pieces through the rolling mill.

3. The apparatus as defined in claim 1, wherein said means for producing a rotating magnetic field includes a pair of coaxial, spaced apart, opposed and parallel discs mounted for rotation about their axes, and a plurality of permanent magnets mounted in each of said discs so as to have alternating north and south poles in an annular array facing the opposed disc and providing the separation space between the opposed discs.

4. The apparatus of claim 1, wherein there are a plurality of separate means for producing rotating magnetic fields vertically spaced from each other in the separation space and a corresponding plurality of said inclined partition means respectively operatively associated with said plurality of means for producing rotating magnetic fields; in the separation space said means for producing rotating magnetic fields having different magnetic field characteristics in the vertical direction that in cooperation with said vertical and inclined partition means first laterally deflect and separate the non-magnetic metal pieces most susceptible to the induction of eddy currents at the first partition means and successive magnetic fields separate the non-magnetic metal pieces in order according to their decreasing susceptibility to induction of eddy currents.

5. The apparatus as defined in claim 4, wherein said means for producing rotating magnetic fields produces the magnetic fields that, in the vertical downward direction, increase in magnetic field intensity from one field to the other.

6. An apparatus as defined in claim 4, wherein said means for producing rotating magnetic fields produces the magnetic fields such that, in the downward vertical direction, they successively increase in rotational speed.

7. The apparatus as set forth in claim 4, wherein said means for producing rotating magnetic fields produces at least three separate magnetic fields having relative strengths such that the top magnetic field will separate only aluminum and its alloys, the second magnetic field will separate only copper and its alloys and the bottom magnetic field will separate only other non-magnetic metals and their alloys from the mixture.

8. An apparatus as set forth in claim 1, wherein said means for producing a rotating magnetic field includes a pair of coaxial, spaced apart, opposed and parallel discs mounted for rotation about their axes, and a plurality of permanent magnets mounted in each of said discs so as to have alternating north and south poles in an annular array facing the opposed disc and providing the separation space between the opposed discs; wherein there are a plurality of separate means for producing rotating magnetic fields vertically spaced from each other in the separation space and a corresponding plurality of said inclined partition means respectively operatively associated with said plurality of means for producing rotating magnetic fields; in the separation space said means for producing rotating magnetic fields having different magnetic field characteristics in the vertical direction that in cooperation with said vertical and inclined partition means first laterally deflect and separate the non-magnetic metal pieces most susceptible to the induction of eddy currents at the first partition means and successive magnetic fields separate the non-magnetic metal pieces in order according to their decreasing susceptibility to induction of eddy currents; said means for producing rotating magnetic fields successively in the vertical downward direction increases the number of permanent magnets from one rotating magnetic field to the other so as to produce successively stronger magnetic fields in the downward direction.

9. The apparatus as defined in claim 1, wherein said means for screening produces a plurality of separate mixtures of different size ranges; said means for receiving freely drops the separate mixture of different size ranges respectively into separate separation spaces; said means for producing a rotating magnetic field produces a plurality of separate rotating magnetic fields respectively in each of the separation spaces.

10. The apparatus as defined in claim 9, wherein there are a plurality of separate means for producing rotating magnetic fields vertically spaced from each other in each separation space, and a corresponding plurality of said inclined partition means respectively operatively associated with said plurality of means for producing rotating magnetic fields; in each separation space said means for producing rotating magnetic fields having different magnetic field characteristics in the vertical direction that in cooperation with said vertical and inclined partition means first laterally deflect and separate the non-magnetic metal pieces most susceptible to the induction of eddy currents at the first partition means and successive magnetic fields separate the non-magnetic metal pieces in order according to their decreasing susceptibility to induction of eddy currents.

11. The apparatus as defined in claim 10, wherein said means for producing rotating magnetic fields produces the magnetic fields that, in the vertical downward direction, increase in magnetic field intensity from one field to the other.

12. The apparatus as defined in claim 10, wherein said means for producing rotating magnetic fields produces the magnetic fields such that, in the downward vertical direction, they successively increase in rotational speed.

13. The apparatus as set forth in claim 10, wherein said means for producing rotating magnetic fields produces at least three separate magnetic fields having relative strengths such that the top magnetic field will separate only aluminum and its alloys, the second magnetic field will separate only copper and its alloys and the bottom magnetic field will separate only other non-magnetic metals and their alloys from the mixture.

14. A method for separation and recovery of crushed non-magnetic metal pieces from a mixture of crushed non-magnetic metal pieces and crushed non-metallic pieces, comprising:

deforming at least said non-magnetic metal pieces among said mixed crushed pieces to a flattened shape of relatively small thickness;

screening the mixture that includes the flattened crushed non-magnetic metal pieces into a given size range of screened mixture;

receiving the screened mixture and freely dropping the screened mixture of crushed pieces including flattened nonmagnetic metal pieces through a separation space to fall freely by gravity;

producing a plurality of separate rotating magnetic fields vertically spaced from each other in said separation space so as produce different magnetic field characteristics in the vertical direction to induce corresponding eddy currents in said flattened non-magnetic metal pieces contained in the screened mixture of freely falling crushed pieces, and thereby first laterally deflecting the freely falling nonmagnetic metal pieces most susceptible to the induction of eddy currents therein from their freely falling path so that successive magnetic fields separate the non-magnetic metal pieces in order according to their decreasing susceptibility to induction of eddy currents, by the electromagnetic forces acting between the rotating magnetic field and the eddy currents generated in the non-magnetic metal pieces;

separating the path of the freely falling prices from the path of the laterially deflected non-magnetic metal pieces, to thereby separate non-metallic pieces from non-magnetic metal pieces according to susceptibility of induced eddy currents;

receiving and containing the separated non-metallic pieces separately and apart from each other according to their susceptibility to induction of eddy currents and from the separate non-magnetic metal pieces.

15. The method of claim 14, wherein said step of producing rotating magnetic fields produces the magnetic fields that, in the vertical downward direction, increase in magnetic field intensity from one field to the other.

16. The method of claim 14, wherein said step of producing rotating magnetic fields produces the magnetic fields such that, in the downward vertical direction, they successively increase in rotational speed.

17. The method of claim 14, wherein the step of producing rotating magnetic fields produces at least three separate magnetic fields having relative strengths such that the top magnetic field will separate only aluminum and its alloys, the second magnetic field will separate only copper and its alloys and the bottom magnetic field will separate only other non-magnetic metals and their alloys from the mixtures.

18. The method of claim 14, wherein said step of screening produces a plurality of separate mixtures of different size ranges; said step of receiving freely drops the separate mixtures of different size ranges respectively into separate separation spaces; said step of producing rotating magnetic fields produces a plurality of separate rotating magnetic fields respectively in each of the separate separation spaces.

19. The method of claim 18, wherein said step of producing rotating magnetic fields produces the magnetic fields that, in the vertical downward direction, increase in magnetic field intensity from one field to the other.

20. The method of claim 18, wherein said step of producing rotating magnetic fields produces the magnetic fields such that, in the downward vertical direction, they succesively increase in rotational speed.

* * * * *